United States Patent [19]

Marcus

[11] 4,430,818

[45] Feb. 14, 1984

[54] ELECTRONIC MOBILE

[75] Inventor: Kenneth N. Marcus, Tipp City, Ohio

[73] Assignee: The Dolly Toy Company, Tipp City, Ohio

[21] Appl. No.: 369,452

[22] Filed: Apr. 19, 1982

[51] Int. Cl.[3] ..... G09F 19/00

[52] U.S. Cl. ..... 40/429; 40/473; 40/614

[58] Field of Search ..... 46/206; 40/617, 614, 40/455, 473, 429

[56] References Cited

U.S. PATENT DOCUMENTS

| | | | |
|---|---|---|---|
| 2,766,849 | 10/1956 | Rudiger | 46/206 |
| 3,031,784 | 5/1962 | Stein | 40/617 |
| 3,456,762 | 7/1969 | Dinnerstein | 40/614 |
| 3,878,642 | 4/1975 | Lemelson | 46/206 |
| 3,927,482 | 12/1975 | Marcus | 40/455 |
| 4,132,021 | 1/1979 | Byers | 40/614 |
| 4,207,696 | 6/1980 | Hyman et al. | 40/473 |
| 4,229,895 | 10/1980 | Byers . | |

*Primary Examiner*—Gene Mancene
*Assistant Examiner*—Wenceslao J. Contreras
*Attorney, Agent, or Firm*—Biebel, French & Nauman

[57] ABSTRACT

A device for storing and delivering rotational energy for rotation of a mobile is used in combination with a source of rotational energy and a control device adapted for intermittent actuation of the energy source for a predetermined period at predetermined intervals. The energy storage device has at least one multi-filament non-braided cords connected between first and second cap members. The first cap member is detachably connected to the energy source and the second cap member is detachably connected to the mobile. The cords are wound by and in response to actuation of the energy source, and urge the mobile to rotate following deactivation of the source. A method of constructing a plurality of the energy storage devices is also disclosed.

8 Claims, 4 Drawing Figures

ELECTRONIC MOBILE

BACKGROUND OF THE INVENTION

The present invention relates to a mobile decorative nursery accessory and, more particularly, to a system for driving the mobile and a method of constructing the same.

Mobiles are well known for the amusement and entertainment of infants and young children. Typically, the mobile includes a number of objects, often brightly colored and of a shape such as would appeal to infants and children, suspended from one or more support arms. The mobile further includes an overhead support member, from which the support arms are hung such that the mobile is rotatable with respect to the overhead support member.

Normally, the rotation of the mobile is one of the features most entertaining to the infant or child. It is known, therefore, to provide a drive means for maintaining a constant rotation of the mobile. In U.S. Pat. No. 3,927,482, issued Dec. 23, 1975 to Marcus, for example, a mobile is disclosed wherein an electric motor powered by household current rotates the mobile.

In U.S. Pat. No. 4,207,696, issued June 17, 1980 to Hyman et al, a mobile is disclosed that is driven for rotation by a battery operated motor. In order to extend the useful life of the battery that powers the motor, an energy storage device is provided connecting the motor shaft with the mobile. The storage device is a cord, spring, wire or the like that is capable of being wound by the motor and subsequently unwinding itself. The motor is activated for only short periods of time so as to wind the storage device which then slowly unwinds so as to urge the mobile to rotate. The intermittent operation of the motor substantially conserves the useful life of the battery.

The preferred embodiment taught by the Hyman et al patent for the energy storage device utilizes a single cord of stranded hemp having a length of approximately four inches and a diameter of approximately 0.012 to 0.015 inches. As illustrated in the drawings of that patent, the cord is connected to the motor by tying the cord to a ring attached at the end of the motor drive shaft. Similarly, the cord is connected to the mobile by tying the cord to a ring formed at the end of a hook member connected in turn to the mobile support arms. Approximately three seconds of motor operation is sufficient to fully wind the cord, whereupon the mobile may be rotated for approximately 90 seconds before rewinding is necessary.

It can be readily seen, of course, that the greater the unwinding time provided by the energy storage device per unit time of motor energization, the greater will be the useful life extension of the battery. Moreover, a close examination of the particular hemp cord embodiment taught by the Hyman et al patent will reveal several disadvantages inherent in that particular energy storage device.

It has been found that the hemp cord has a relatively short useful life. The winding and unwinding of the cord tends to wear the fibers of the cord, resulting in its breakage, even after relatively little use. It can be seen, then, that replacement of the cord by the purchaser of the mobile will become necessary. Yet tying the cord at each end to connect it between the motor shaft and the mobile is, at best, a tedious operation.

These two disadvantages work together, resulting in great inconvenience to the purchaser.

It will also be readily apparent that the relative difficulty of attaching the cord by tying it to rings poses difficulties in the manufacture of the mobile.

What is needed, therefore, is an energy storage device for use with a motor driven mobile that will have a long useful life without rapid wear and subsequent breakage. Such a storage device should be relatively simple in its insertion into the mobile, both during initial manufacture of the toy and in the event subsequent replacement should become necessary. It should give a long unwinding period for rotating the mobile with only a very short energization period for the motor. Additionally, the energy storage device itself should be simple and inexpensive to manufacture.

SUMMARY OF THE INVENTION

The present invention provides a device for storing and delivering rotational energy. The device is for use in combination with a source of rotational energy adapted for actuation for a predetermined period at predetermined intervals, and with an object to be rotated. In its particular application, the device is used in a decorative nursery accessory for storing and delivering the rotational energy to a mobile, wherein the source of rotational energy may be an electric motor having a shaft.

The energy storage device includes at least one multi-filament non-braided cord, each of the cords being operatively connected at one end to the motor shaft, whereby the cords are wound by and in response to actuation of the motor. Each cord is further operatively connected at its opposite end to the object to be rotated, whereby the object is urged to rotate following deactuation of the motor.

The cords used in the energy storage device may be of a synthetic fiber such as a nylon material.

The energy storage device may further include a pair of cap members. A first of the cap members is detachably connected to the shaft of the motor, and the second of the cap members is detachably connected to the object to be rotated. Each of the cords is extended between and connected at each end to the two cap members.

The cap members may each be constructed of a molded plastic material such as thermo-plastic material.

The invention further includes a method for constructing a plurality of the energy storage devices. Molds are provided for forming a cap member in each of the molds. At least two of the multi-filament non-braided cords are extended in continuous fashion from one of the molds to each successive mold. The molds are then filled with a molten plastic material such that a portion of each of the cords is surrounded by the material at each mold. Thus, the plastic material effectively defines connected segments along each of the cords. The molds and plastic material are then cooled such that the material solidifies to form a cap member in each of the molds. Alternate ones of the segments of each cord defined by the cap members are then cut away, and the cap members are removed from the molds.

Accordingly, it is an object of the present invention to provide a device for storing and delivering rotational energy, for use in combination with a source of rotational energy and an object to be rotated, having at least one multi-filament non-braided cords with each operatively connected between the energy source and object to be rotated; to provide such a device that has a long useful life; to provide such a device that is simple to install; to provide such a storage device that yields a very long period of rotation relative to an actuation period for the energy source; to provide such a device that utilizes relatively inexpensive materials; and to provide a method for constructing such devices that is relatively quick and inexpensive to perform.

Other objects and advantages of the invention will be apparent from the following description, the accompanying drawings and the appended claims.

DETAILED DESCRIPTION OF THE PREFERRED EMBODIMENT

Figure 1:
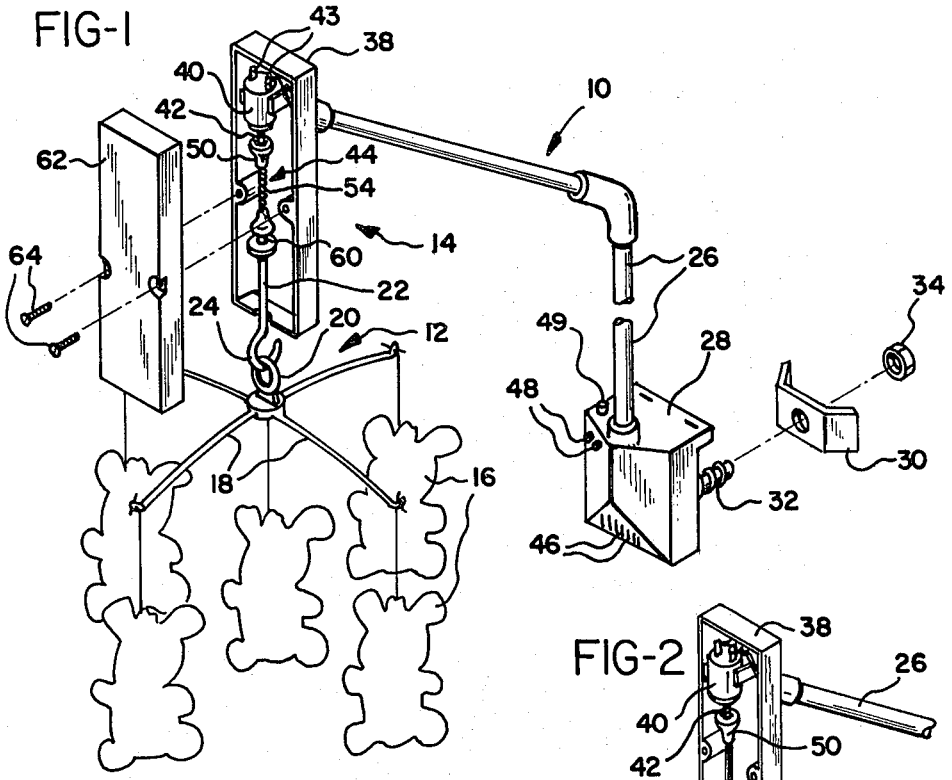
FIG. 1 is a perspective view of a decorative nursery accessory having a removable portion of the motor housing removed, illustrating the energy storage device of the present invention in a wound state.

Referring now to the drawings, and in particular to FIG. 1, a decorative nursery accessory 10 includes a mobile 12 suspended from a support member 14. The mobile 12 includes a plurality of objects 16 which may be of various shapes and colors. Each object 16 is supported from one of several support arms 18, which are connected together and supported by ring member 20.

Mobile 12 further includes a post member 22 having a hook 24 defined at one end thereof. Hook 24 is engageable with ring member 20 and thereby supports the remainder of mobile 12.

The support member 14 includes a tubular support shaft 26 mounted to a control housing 28. Housing 28 may be attached to crib bars or a crib rail (not shown) by placing a bracket 30 onto a threaded bolt 32 mounted to housing 28 and against the bars or rail on a side opposite housing 28. Bracket 30 is then clamped against the bars or rail by tightening a nut 34 onto bolt 32.

A drive housing 38 is provided, mounted to the upper end of support shaft 26. An electric motor 40 is mounted in the interior of housing 38, oriented with its drive shaft 42 extending therefrom in a vertically downward direction. Motor lead wires 43, connected to motor 40, extend down the interior of support shaft 26 to the control housing 28. As will be explained in detail below, motor shaft 42 is operatively connected to the upper end of post member 22 by a device for storing and delivering rotational energy 44. Motor 40 and energy storage and delivery device 44 cooperate to impart a rotational motion to the mobile 12.

An appropriate control circuit (not shown) is enclosed within control housing 28. The control circuit may be of the type shown in Hyman et al, U.S. Pat. No. 4,207,696, which is herein incorporated by reference. Other control circuits of conventional design may be used and adapted to control actuation of motor 40 in a manner to be described below. In addition, the control circuit may be adapted for the production of electronic musical sounds which are supplied to a loudspeaker (not shown) located within control housing 28 and mounted behind louvers 46 defined in one wall of housing 28. The musical sounds are generated by the control circuit so as to form melodies such as would be appealing to infants and children, the melodies being performed one after another in a predetermined sequence.

The control housing 28 further contains control switches 48 and 49 which are provided to enable the operator of the nursery accessory 10 to commence rotation of the mobile 12 and/or the production of musical sounds. Switches 48 cooperate with the control circuit in a conventional manner, so as to enable the operator to select operation of the accessory 10 for a predetermined time period. A switch 49 is provided for selecting one of several programs of melodies.

Figure 3:
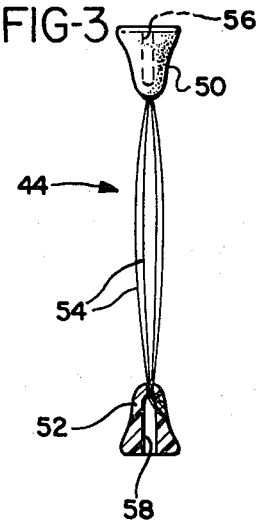
FIG. 3 is a view of the energy storage device disconnected from the accessory.

As shown in FIG. 3, the energy storage device 44 includes end cap members 50 and 52, connected by at least one multi-filament non-braided cord 54. Each of the cap members 50 and 52 is preferably molded from a thermo-plastic material such as a vinyl plastic, and each of the cords 54 is connected to the cap members 50 and 52 by molding the cap members about the cords 54 such that the cords are embedded within the plastic material of the cap members.

Each of cap members 50 and 52 is formed having a substantially cylindrical cavity 56 and 58, respectively, defined along the bottom surface thereof. Cavity 56 is of a diameter such that cap member 50 may be friction fitted onto the end of shaft 42 of motor 40. Cavity 58 is of a diameter such that cap member 52 may be friction-fitted onto a cylindrical protrusion 60 projecting axially from the top of post member 22.

In the preferred embodiment, four of the cords 54 are used. The multi-filament non-braided cords are preferably of a synthetic fiber such as a nylon material, and may be formed of lengths of commercially available unwaxed dental floss. More preferably, the dental floss may be Butler "Right Kind" dental floss, manufactured by John O. Butler Company of Chicago, Ill.

Figure 2:
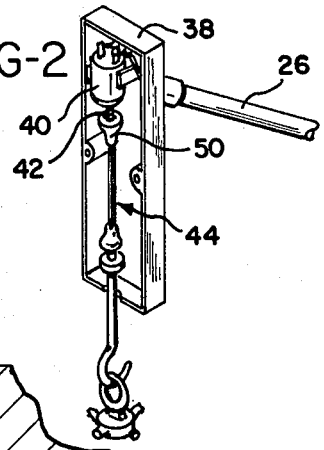
FIG. 2 is a fragmentary portion of the view of FIG. 1 illustrating the energy storage device in an unwound state.

The operation of the energy storage device may be seen by comparing FIGS. 1 and 2. As seen in FIG. 1, motor 40 has been energized, driving shaft 42 and rotating cap member 50, whereby the cords 54 have been fully wound. Under the control of the control circuit, the motor 40 is energized for a predetermined period sufficient to wind cords 54 to approximately their full extent. Following deenergization of motor 40, the cords 54 begin to unwind, imparting a rotation to post member 22 and thereby to the mobile 12. Mobile 12 is rotated by the energy storage device 44 until the device is completely unwound as shown in FIG. 2. The control circuit may cause motor 40 to be energized again, rewinding cords 54.

It has been found through testing of the disclosed energy storage device that use of cords of the material described herein virtually eliminates the problems of wear and breakage of the device. Further, it has been found that these cords are capable of greater energy storage than the previously known cords, thereby providing for extended life of the battery operating the accessory 10. For example, it is noted in U.S. Pat. No. 4,207,696 that use of a hemp cord for energy storage results in approximately 90 seconds of unwinding for three seconds of motor energization. Using cord materials as disclosed herein, however, it has been found that approximately 140 seconds of unwinding may be obtained with one-half second of motor energization. This increase is particularly significant since motor energization represents the largest drain upon the battery.

During manufacture of the accessory 10, or in the event replacement of energy storage device 44 should become necessary, by referring again to FIG. 1, the relative ease with which the energy storage device 44 may be installed into or removed from the accessory 10 may be appreciated. Drive housing 38 includes a removable portion 62, normally held in place on housing 38 by screws 64. Removal of screws 64 and housing portion 62 provide easy access to motor 40, shaft 42, energy storage device 44, and the upper portion of post member 22. Because cap member 50 is friction-fit onto shaft 42 and cap member 52 is friction-fit onto post member 22, removal of energy storage device 44 is simply a matter of pulling cap members 50 and 52 from shaft 42 and post member 22, respectively, and installation of energy storage device 44 is simply a matter of press-fitting cap members 50 and 52 onto the ends of shaft 42 and the protrusion of post member 22, respectively.

Figure 4:
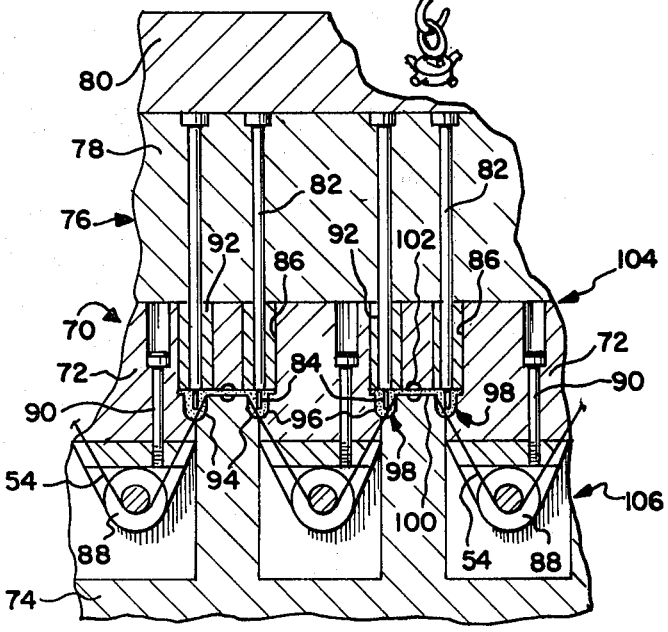
FIG. 4 illustrates a molding apparatus for the manufacture of a plurality of energy storage devices.

Quantities of the disclosed energy storage device 44 may be produced by a method using the molding apparatus 70 shown in FIG. 4. Molding apparatus 70 includes a frame 72, a lower movable portion 74, and an upper movable portion 76. Upper portion 76 includes upper frame plate 78, retaining plate 80 mounted thereto, and a plurality of pins 82 extending through upper frame plate 78 and held in place by retaining plate 80. Each of pins 82 includes a protrusion 84 at its lower end. Pins 82 extend into frame 72 through a plurality of bores 86 defined in frame 72.

Frame 72 includes a plurality of pulleys 88 mounted to frame 72 by screws 90. Additionally, a bushing 92 is inserted into each of bores 86, disposed about pin 82.

When the molding apparatus 70 is closed, as shown in FIG. 4, lower portion 74 cooperates with frame 72 such that a plurality of recesses 94 in lower portion 74 and a plurality of recesses 96 in frame 72 cooperate to form a plurality of molds 98 for shaping one of the end cap members 50 or 52 within each mold 98. Protrusion 84 of one of the pins 82 extends into each mold 98 for forming the cavity 56 or 58 of cap member 50 or 52, respectively. Molds 98 are arranged into pairs, with the molds 98 of each pair being connected by a channel 100 formed by cooperating grooves defined into frame 72 and lower portion 74. A supply channel 102, also formed by cooperating grooves defined into frame 72 and lower portion 74, connects with channel 100.

The method of using the molding apparatus 70 for producing quantities of the energy storage device 44 is described as follows. Molding apparatus 70 is opened along break lines as indicated generally at 104 and 106. When opened, upper portion 76 is raised above frame 72 sufficiently to retract protrusions 84 of pins 82 completely into bores 86. At the same time, lower portion 74 is lowered beneath frame 72 such that lower portion 74 is completely beneath pulleys 88. At least one of the multi-filament non-braided cords 54 is then drawn into the molding apparatus 70 beneath pulleys 88 but above lower portion 74. Molding apparatus 70 is then closed as shown in FIG. 4, drawing cords 54 into engagement with spools 88 and into each of molds 98, thereby fixing the lengths of the sections of cords 54 extending between molds 98.

A molten thermo-plastic material is supplied to each of molds 98 by injecting the material into molds 98 through channels 102 and 100. The material flows around cords 54 in each mold 98, surrounding cords 54 and bonding to them. Thus, connected segments of cords 54 are defined, with one set of alternate segments of uniform length extending about pulleys 88, and a second set of alternate segments extending between pairs of molds 98 along each channel 100. The material within molds 98 is then cooled and solidified by cooling the portions of the molding apparatus 70 surrounding and defining molds 98, for example, by passing water through a plurality of cooling conduits (not shown) in the apparatus 70.

Once the material within each of molds 98 are solidified to form a cap member therein, the apparatus 70 is opened along lines 104 and 106. The cap members are ejected from the apparatus 70, and the cords 54 are again moved along within apparatus 70. The cap members just formed are drawn out from apparatus 70, which subsequently closes on portions of cords 54 newly drawn into the apparatus 70, and the cycle is repeated.

Finally, at a separate work station which may be remote from molding apparatus 70, the alternate segments of cords 54 defined along channel 100 are cut away from the cap members, along with any sprues of the plastic material which may have been formed along the various supply channels during the molding process.

It will be recognized that, depending on the number of molds 98 provided within molding apparatus 70, any number of the energy storage devices 44 may be produced within a single cycle of operation of apparatus 70.

While the forms of apparatus and method herein described constitute preferred embodiments of this invention, it is to be understood that the invention is not limited to these precise forms of apparatus and method and that changes may be made in either without departing from the scope of the invention which is defined in the appended claims.

What is claimed is:

1. A device for storing and delivering rotational energy, for use in combination with a source of rotational energy including a motor having a shaft and adapted for actuation for a predetermined period at predetermined intervals, and an object to be rotated, the device comprising:

at least one multi-filament non-braided cord, each said cord operatively connected at a first end thereof to said rotational energy source, whereby said cords are wound by and in response to actuation of said energy source;

each said cord further being operatively connected at a second end thereof to said object to be rotated, whereby said object is urged to rotate following deactivation of said energy source; and first and second cap members, said first cap member being detachably connected to said shaft of said motor, said second cap member being detachably connected to said object to be rotated, said first and second cup members further having each of said cords connected therebetween.

2. The device as defined in claim 1, wherein said first and second cap members are of a molded plastic material.

3. The device as defined in claim 2 wherein said molded plastic material is a vinyl plastic.

4. In an apparatus for rotation of a mobile, including a source of rotational energy and a control means therefor adapted for intermittent actuation of said source for a predetermined period at predetermined intervals, the improvement comprising:

means for storing and delivering rotational energy having a plurality of multi-filament non-braided cords, each said cord being constructed of a synthetic fiber and operatively connected at a first end thereof to said rotational energy source, whereby said cords are wound by and in response to actuation of said energy source, each said cord further being operatively connected at a second end thereof to said mobile, whereby said mobile is urged to rotate following deactivation of said energy source.

5. The device as defined in claim 4 wherein said synthetic fiber is a nylon material.

6. The apparatus as defined in claim 4 wherein said source of rotational energy is a motor having a shaft.

7. In an apparatus for rotation of a mobile, including a source of rotational energy and a control means therefor adapted for intermittent actuation of said source for a predetermined period at predetermined intervals, said source including a motor having a shaft, the improvement comprising:

means for storing and delivering rotational energy having at least one multi-filament non-braided cord, each said cord operatively connected at a first end thereof to said rotational energy source, whereby said cords are wound by and in response to actuation of said energy source, each said cord further being operatively connected at a second end thereof to said mobile, whereby said mobile is urged to rotate following deactivation of said source, said energy storage and delivery means further including first and second cap members, said first cap member being detachably connected to said shaft of said motor, said second cap member being detachably connected to said mobile, said first and said second cap members further having each of said cords connected therebetween.

8. The apparatus as defined in claim 7 wherein said cords are of a nylon material.

* * * * *